US008960937B2

(12) United States Patent
Yang

(10) Patent No.: US 8,960,937 B2
(45) Date of Patent: Feb. 24, 2015

(54) STRUCTURE OF BASE FOR DECORATIVE AQUATIC BALL

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 5 days.

(21) Appl. No.: 13/798,165

(22) Filed: Mar. 13, 2013

(65) Prior Publication Data

US 2014/0268662 A1 Sep. 18, 2014

(51) Int. Cl.
*F21V 33/00* (2006.01)
*F21V 21/00* (2006.01)

(52) U.S. Cl.
CPC ..... *F21V 21/00* (2013.01); *Y10S 362/806* (2013.01)
USPC ..... 362/101; 362/154; 362/186; 362/363; 362/806; 446/267; 40/406; 40/410

(58) Field of Classification Search
CPC ..... F21Y 2101/00; F21S 10/00; F21S 10/002
USPC ..... 362/101, 154, 186, 190, 253, 363, 382, 362/806, 808, 809
See application file for complete search history.

*Primary Examiner* — Anh Mai
*Assistant Examiner* — Meghan Dunwiddie
(74) *Attorney, Agent, or Firm* — Leong C. Lei

(57) ABSTRACT

The structure of base for decorative aquatic ball mainly contains a shell, a hollow transparent shell made of plastic material; a decorative layer, a laser paper film with a pattern, the laser paper film covering the inner wall of the shell; and a decorative aquatic ball, a light-transmittable three-dimensional shape, disposed on top of the shell, and sealing in a fluid with slightly higher viscosity. As such, the decorative layer enables the base carrying the aquatic ball to create rich and layered visual effects.

3 Claims, 3 Drawing Sheets

STRUCTURE OF BASE FOR DECORATIVE AQUATIC BALL

TECHNICAL FIELD OF THE INVENTION

The present invention generally relates to a structure of base for decorative aquatic ball, and more particularly to a base for carrying and supporting an aquatic ball, and having laser paper inside the base.

DESCRIPTION OF THE PRIOR ART

A general household usually uses decorative lamps to enhance the ambient lighting in living room and bedrooms in addition to large ceiling light to illuminate the entire ambient. The small decorative lamp can be used for both small-area luminance or simply for decorative purpose to create a specific ambience. However, the majority of decorative objects only show static esthetics, Therefore, an aquatic lamp is developed to provide additional dynamic visual results. The aquatic lamp often contains glittering particles or bits and other decorative pieces. By manually shaking the aquatic lamp or powered by electricity, the glittering particles or bits and other decorative pieces contained inside the aquatic lamp can flow to create a fluid visual effect. As the objects contained inside the aquatic lamp can vary, different visual effects can be created to explore more varieties. Nevertheless, the variations are often limited to the inside of the aquatic ball, therefore, the results are also limited. It is therefore desirable for enhance the decorative and illuminant aquatic lamp with additional parts to further extend the usability of the aquatic lamp.

SUMMARY OF THE INVENTION

The primary purpose of the present invention is to provide a structure of base for decorative aquatic ball.

The structure of base for decorative aquatic ball includes: a shell, a hollow transparent shell made of plastic material; a decorative layer, a laser paper film with a pattern, the laser paper film covering the inner wall of the shell; and a decorative aquatic ball, a light-transmittable three-dimensional shape, disposed on top of the shell, and sealing in a fluid with slightly higher viscosity. As such, the decorative layer enables the base carrying the aquatic ball to create rich and layered visual effects.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
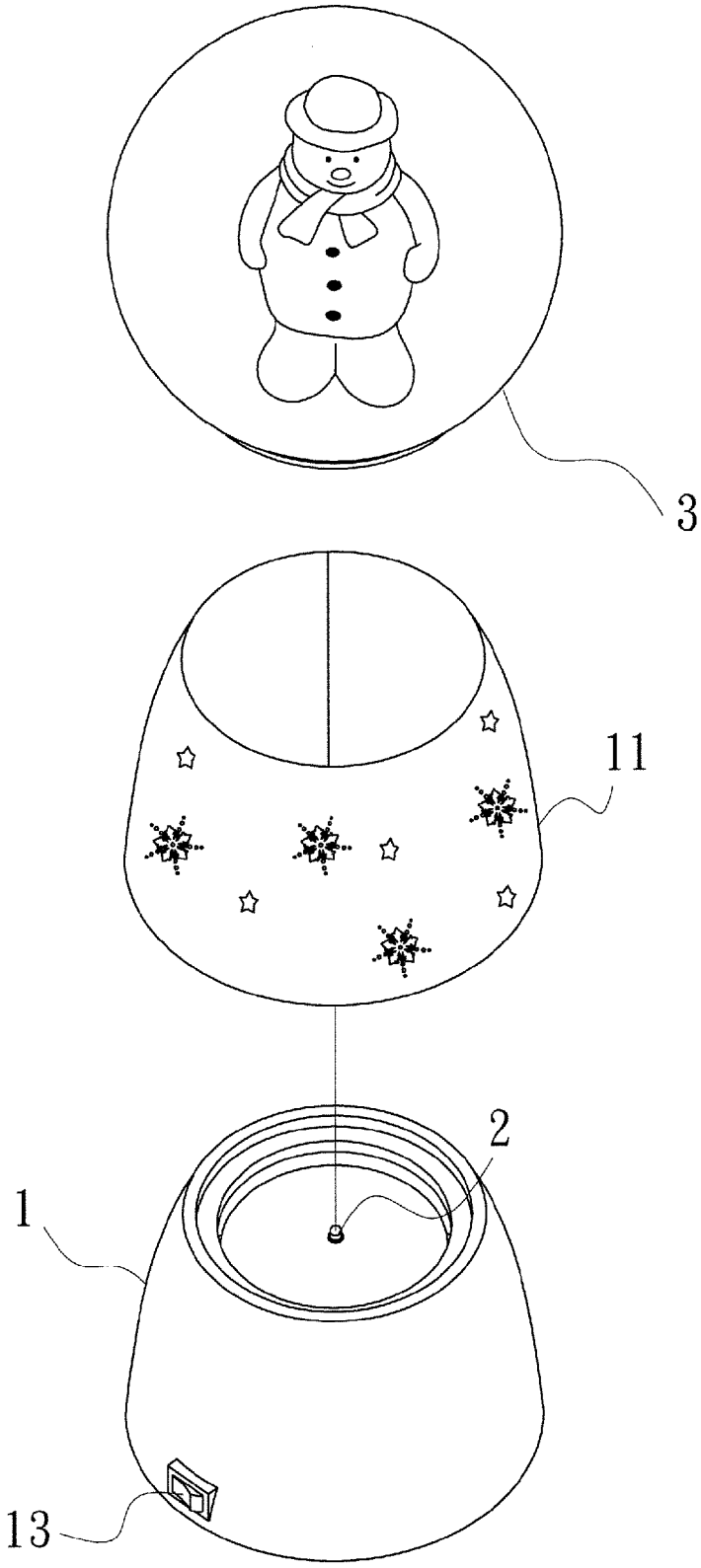
FIG. 1 is a perspective diagram showing a structure of base for aquatic ball according an embodiment of the present invention.
Figure 2:
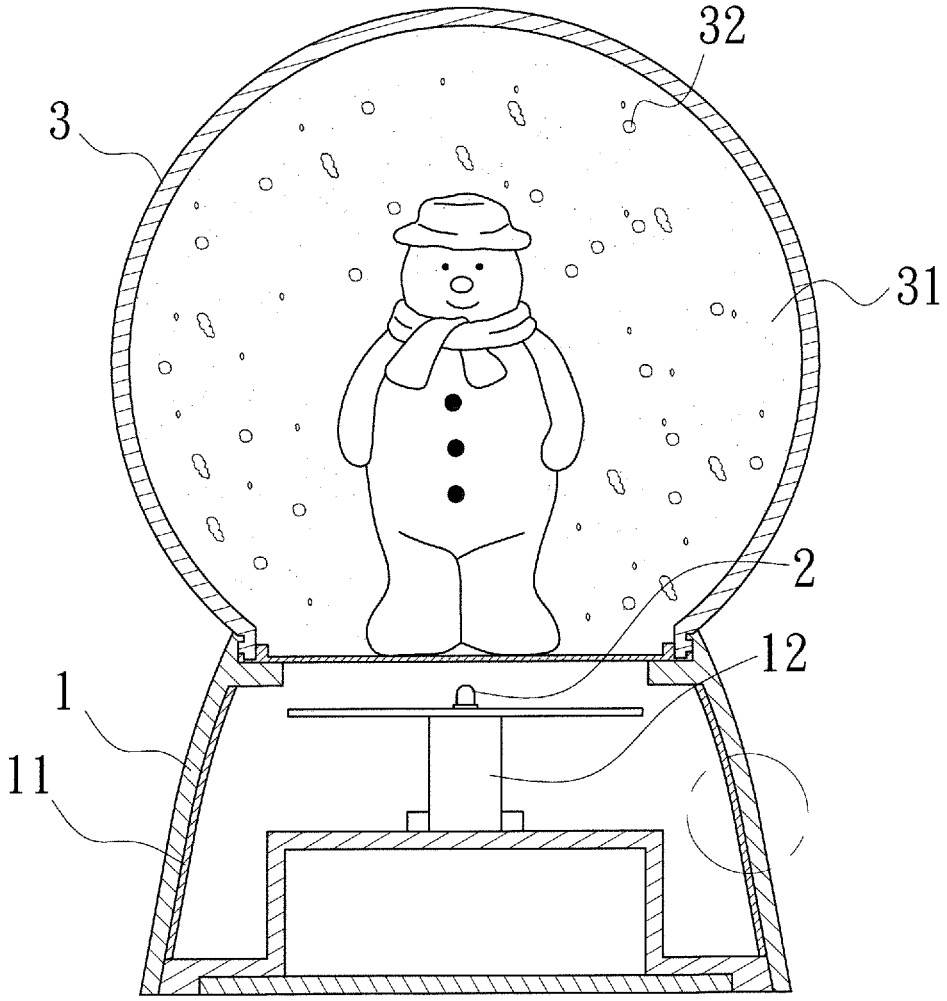
FIG. 2 is a cross-sectional diagram showing a structure of base for aquatic ball of according an embodiment of the present invention.
Figure 3:
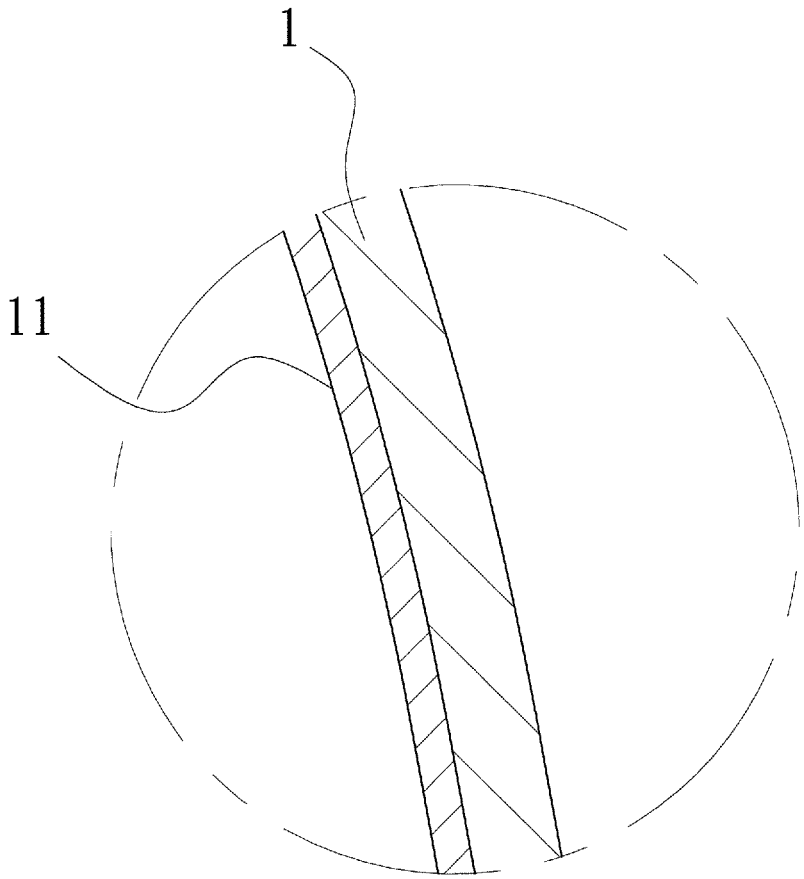
FIG. 3 is a partial enlarged diagram showing the structure of base for aquatic ball of according an embodiment of the present invention.

As shown in FIGS. 1 to 3, a structure of base for aquatic ball according to an embodiment of the present invention mainly contains:

A shell 1: a hollow transparent shell 1 made of plastic material; further including a circuit set 12, one side of the shell 1 including a switch 13 electrically connected to a power source, the switch 13 being electrically connected to the circuit set 12;

A decorative layer 11: a laser paper film with a pattern, the laser paper film covering the inner wall of the shell 1;

A light-emitting element 2: being disposed inside the shell 1 and electrically connected to the circuit set 12 of the shell 1, the switch 13 controlling ON and OFF of the light-emitting element 2; and A decorative aquatic ball 3: a light-transmittable three-dimensional shape, disposed on top of the shell 1, and sealing in a fluid 31 with slightly higher viscosity. The fluid remains flow-able.

In addition to the fluid 31 sealed in, the aquatic ball 3 can further includes glittering particle and bits 32, or a three-dimensional decorative piece to enrich the contents of the aquatic ball 3.

The decorative layer 11 uses an injection tool to inject a transparent material onto a laser paper to the full extent so that the paper shows the surface tension to bend slightly. The laser paper is then placed a period of time to cure and become fixed in shape to form a plastic film with laser pattern. Through the transparent material on the surface, the plastic film allows the light to transmit to reach the underneath laser paper and reflects the laser pattern. The present invention disposes the decorative layer 11 inside the transparent shell so as to create rich and layered visual effects.

When the light-emitting device 2 emits light, the emitted light can slightly transmit through the shell 1. The circuit set 12 can control the light-emitting element 2 to switch color of light so as to enhance the visual result of the decorative layer 11. As such, the shell 1 supporting the decorative aquatic ball 3 can generate rich luminance effect and layered visual result.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of base for decorative aquatic ball, comprising:

a hollow transparent shell made of plastic material;

a laser paper film with a pattern, the laser paper film covering the inner wall of the shell; and a decorative aquatic ball having a light-transmittable three-dimensional shape, disposed on top of the shell, and sealing in a fluid with slightly higher viscosity.

2. The structure of base for decorative aquatic ball according to claim 1, further comprising: a light-emitting element disposed inside the shell, and a circuit set being disposed for electrical connection to the light-emitting element, a switch being disposed at one side of the shell for electrical connection to a power source for obtain power, and the switch being electrically connected to the circuit set.

3. The structure of base for decorative aquatic ball according to claim 2, wherein the circuit set can control the light-emitting element to switch the color of light.

* * * * *